US006710269B2

(12) United States Patent
Kunigkeit et al.

(10) Patent No.: US 6,710,269 B2
(45) Date of Patent: Mar. 23, 2004

(54) FOIL KEYBOARD WITH SECURITY SYSTEM

(75) Inventors: Eckhard Kunigkeit, Stuggart (DE); Thomas Walz, Niefern (DE)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 10/198,452

(22) Filed: Jul. 18, 2002

(65) Prior Publication Data

US 2003/0025617 A1 Feb. 6, 2003

(30) Foreign Application Priority Data

Jul. 18, 2001 (EP) ..... 01117357

(51) Int. Cl.[7] ..... H01H 9/00

(52) U.S. Cl. ..... 200/5 A; 200/510; 200/300; 200/334; 200/61.93

(58) Field of Search ..... 200/5 A, 510, 200/511, 512, 513, 300, 334, 61.93, 61.08

(56) References Cited

U.S. PATENT DOCUMENTS 5,763,840 A * 6/1998 Liao ..... 345/174
5,872,560 A * 2/1999 Droege et al. ..... 345/168
5,936,557 A * 8/1999 Liddle ..... 341/34
5,999,097 A * 12/1999 Liddle et al. ..... 340/550

* cited by examiner

*Primary Examiner*—Karl D. Easthom
*Assistant Examiner*—K. Lee
(74) *Attorney, Agent, or Firm*—Carlos Munoz-Bustamonte

(57) ABSTRACT

The present invention discloses a foil keyboard with a security system for detecting and preventing unauthorized mechanical access to the key contacts. The foil keyboard comprising a foil having for each key an elastic key spring area in which an electrical contact is arranged, a printed circuit board (PCB) having electrical contacts that are contacted by the electrical contacts of the keys during the key travel, and a security system which is fully integrated into the foil and the PCB. A closed circuit between keyboard foil and PCB forms a security grid that secures that unauthorized mechanical accesses against key contacts are recognized.

15 Claims, 3 Drawing Sheets

FOIL KEYBOARD WITH SECURITY SYSTEM

BACKGROUND OF THE INVENTION

The present invention relates generally to a foil keyboard and in particular to a foil keyboard which secures the keys and their electrical contacts against unauthorized access.

At the present time a range of equipment is employed in Automatic Teller Machines (ATM) and for electronic funds transfer (EFT or electronic cash) for data entry or output. Certain security provisions are associated with this equipment in order to be able to avoid any possible undesired manipulation. The security of confidential information and the protection of data input and output from possible influences or manipulation is generally effected by means of electronic or mechanical security measures, such as, for example, the physical incorporation of various security-relevant components into one security module. Particularly security-sensitive components or modules are, in particular, data input keyboards, key memory for storing confidential keys, e.g. for coding data transfer and security circuits for electronic protection of security-relevant components. Thus, keyboards in particular, have to be protected against simultaneous disclosure of input data, such as a personal identification number (PIN).

A security module for an electronic funds transfer system is known from European Patent Application EP A-0186981. The security module is located in an impact-resistant housing. The module has a PIN entry block and can key confidential data, such as, for example, the PIN, and thus offers access to these data to other equipment.

An extensive study of the physical security of systems for an electronic funds transfer is known from the IBM document "Physical Security for the IBM Transaction Security System", IBM Charlotte, N.C., 28257, May 6, 1991 by G. P. Double. This document proposes various test methods and possible protective measures. In particular, this document teaches the use of a so-called Intrusion Detection Screen for the electronic detection of mechanical penetration of the film. The intrusion detection screen comprises a flexible circuit board with thin meandering conductor paths or a combination of flexible circuit board with thin meandering conductor paths and a printed circuit board with integrated thin meandering conductor paths. If the conductor paths are short-circuited or destroyed by mechanical action, such as, for example, penetration or tearing, this will be recognized by one of the inbuilt security switches. A monitoring logic connected to the intrusion detection screen recognizes changes in the resistance network of the protective film and sets off a suitable alarm which can lead, for example, to the deletion of security-relevant data.

To make manipulations at keyboards, which are intended, for example, for use in ATMs or electronic funds transfer, more difficult, a range of measures is known which will enhance data security. A known method for this is to encapsulate the electronics to be protected including the keyboard.

Apart from the encapsulation method, it is also usual to embed the security logic with data memory and the keyboard required for data input, in a housing and to wrap the housing in a security film. The security film is here designed in such a way that removal of or damage to the security film will lead to a corresponding alarm.

Apart from the data memory, which contains any security-relevant data, the keyboard must be protected so as to prevent or make more difficult the unauthorized 'theft' of the information input, such as, for example, a personal identification number (PIN). Total encapsulation of the keyboard, however, is not possible, since the keyboard must be at least partially accessible for input.

A security keyboard is known from the IBM Technical Disclosure Bulletin, Vol.33, No.9, February 1991, pp. 448–449, in which the contact portions of the keyboard are disposed within a region protected by a security film while the keys themselves remain outside the protected region and are thus accessible to the user. The arrangement of the keys at the security film is such that an unauthorized mechanical access to the key contacts at the security film cannot be detected.

Another prior art security keyboard with a security system is shown in FIG. 1. That security keyboard consists of a printed circuit board (PCB) 1 having a security module 2 containing all security relevant functions encapsulated with a security film that is connected to one inbuilt security switch (not shown). When the key 4 is pressed the metal dome 5 snaps in and shortens the electrical contacts 3 for the key, which will be recognized by the inbuilt security switch as a valid key stroke. Furthermore, the PCB 1 has one or more security electrical contacts 6 with an assigned metal dome 7. The security electrical contact 6 is connected to an in-built security switch. When keyboard is assembled and mounted using screws and nuts 12, the cover 11, spacer 10, and gasket 9 force metal dome 7 to snap in and to shorten security contacts 6. This indicates the in-built security switch that the keyboard is assembled correctly. Otherwise the security switch will erase all security-relevant data. Attempts to manipulate the keyboard, for example recording of input data, e.g. PINs, requires mechanical access to the keys 4 and their contacts 3. This requires disassembling of the keyboard which leads the electrical contact 6 from the closed to the open state. This activates the in-built security switch, the electrical contact 6 is connected to and erases all security-relevant data. A disadvantage of that security keyboard is that a weakening of the spring force of the metal dome can unintentionally activate the security switch resulting in cancellation of all security relevant data. Furthermore, the security keyboard is complex in structure and assembly.

SUMMARY OF THE INVENTION

It is therefore a purpose of the present invention to provide a foil keyboard with a simple and low cost security system for detecting unauthorized mechanical access to the key contacts however avoiding the disadvantages of prior art security systems.

This purpose is solved by the features of the independent claims. Preferred embodiments of the present invention are laid in the dependent claims.

The present invention discloses a foil keyboard with a security system for detecting and preventing unauthorized mechanical access to the key contacts. The foil keyboard comprising a foil having for each key an elastic key spring area in which an electrical contact is arranged, a printed circuit board (PCB) having electrical contacts that are contacted by the electrical contacts of the keys during the key travel, and a security system which is integrated into the foil and the PCB. The security system itself comprises a first arrangement of conductors disposed at the inner surface of the foil and placed around the key entry block area, a second arrangement of conductors disposed at the PCB, electrical contacts arranged at the conductors of the foil and the PCB for electrically connecting the first and second arrangement of conductors, and a security switch for providing power means and detections means. Each conductor of the first and second arrangement of conductors is followed by short non-conductive area. The first and second arrangements are arranged to each other such that each non-conductive area of the first arrangement is electrically bridged via an electrical contact with an opposite conductor of the second arrangement of conductors and each non-conductive area of the second arrangement of conductor is electrically bridged by via the electrical contact with an opposite conductor of the first arrangement of conductors in order to built a closed circuitry between first and second arrangement of conductors when power is applied. The closed circuit between keyboard foil and PCB forms a security grid that secures that unauthorized mechanical accesses against key contacts are recognized by the detecting means of the security switch. This inventive foil keyboard provides a simple and low cost keyboard combining the security standard for protecting security-relevant data inside the keyboard as well as providing additional security requirements with respect to unauthorized mechanical access to the key contacts without requiring additional components.

BRIEF DESCRIPTION OF THE DRAWINGS

Some of the purposes of the invention having been stated, others will appear as the description proceeds, when taken in connection with the accompanying drawings, in which.

DETAILED DESCRIPTION OF THE ILLUSTRATIVE EMBODIMENTS

While the present invention will be described more fully hereinafter with reference to the accompanying drawings, in which a preferred embodiment of the present invention is shown, it is to be understood at the outset of the description which follows that persons of skill in the appropriate arts may modify the invention here described while still achieving the favorable results of this invention. Accordingly, the description which follows is to be understood as being a broad, teaching disclosure directed to persons of skill in the appropriate arts, and not as limiting upon the present invention.

Figure 1:
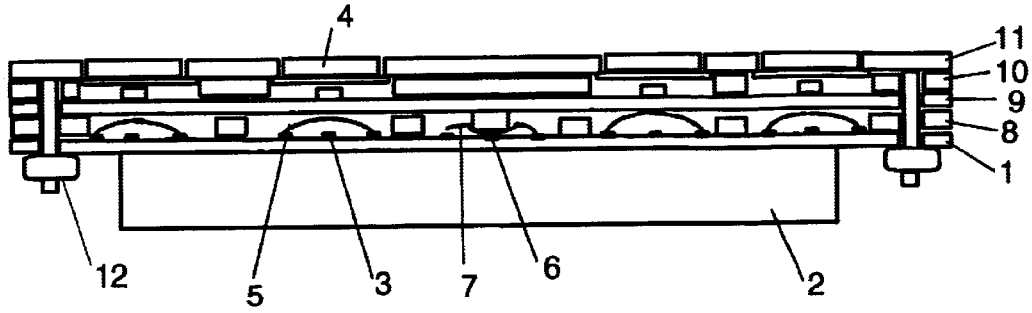
FIG. 1 shows a prior art security keyboard.
Figure 2A:
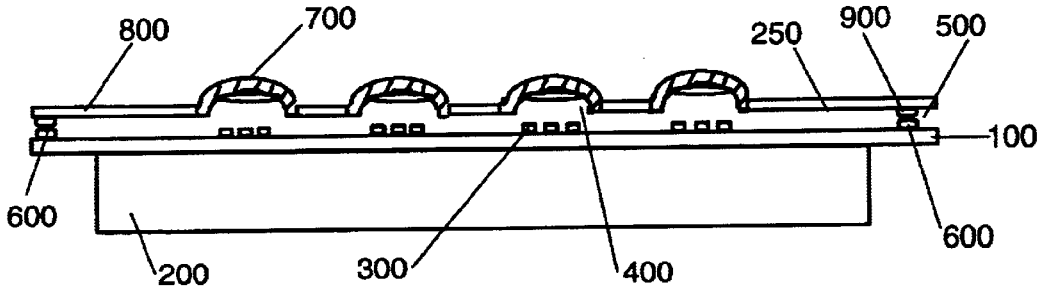
FIG. 2A shows a sectional view through a preferred embodiment of a the foil keyboard in an assembled state in accordance with the present invention.

Referring now more particularly to the accompanying drawings, FIG. 2A shows a sectional view through a preferred embodiment of a foil keyboard in an assembled state in accordance with the present invention.

The foil keyboard includes a PCB 100, a security module 200 encapsulated with a security film that is connected to one in-built security switch (not shown), and a keyboard foil 800. The PCB 100 has electrical contacts 300 for each key of the key entry block. The keys 700 themselves are integrated into the keyboard foil 800 that is directly arranged at the PCB 100 preferably using adhesive material. The keys 700 in the keyboard foil 800 are embossed and have conductive material 400 at their inner surface. When pressing the key 700 the conductive material 400 contacts the electrical contacts 300 at the PCB. The closed contacts are recognized by the in-built switch as a valid key stroke. The keyboard foil 800 comprises a first arrangement of conductors 900 arranged at the inner surface 250 of the foil 800 and placed around the key entry block area. Each conductor 900 is followed by a non-conductive area (not shown). The conductors are preferably squarely arranged around the key entry block. A second arrangement of conductors 600 is arranged at the PCB 100 which is preferably identical in shape and size with the first arrangement except that each conductor of the first arrangement of conductors has an assigned opposite non-conductive area of the second arrangement. This applies accordingly for conductors of the second arrangement of contactors 600. Each conductor is also followed by a non-conductive area. Electrical contacts are arranged at the conductors of the first 900 and second 600 arrangement of conductors for electrically connecting first 900 and second 600 arrangement of conductors. The conductors of the first 900 and second 600 arrangements are arranged to each other such that each non-conductive area of the first arrangement 900 is electrically bridged via an electrical contact with an opposite conductor of the second arrangement of conductors 600 and each non-conductive area of the second arrangement of conductor 600 is electrically bridged by via the electrical contact with an opposite conductor of the first arrangement of conductors 900 in order to built a closed circuitry between first 900 and second 600 arrangement of conductors when power is applied. The closed circuit between keyboard foil 800 and PCB 100 forms a security grid that secures that mechanical attacks against key contacts are recognized by the detecting means of the security switch. The first 900 and second 600 arrangement of conductors are commonly connected with a security switch that is preferably part of the security module. The security switch comprises power supply means for providing a closed circuitry in the first and second arrangement of conductors and detection means for analyzing changes of voltages/current in the closed circuitry. When a mechanical access to the key contacts is sensed by the detection means all security relevant data are automatically erased. In a further preferred embodiment of the present invention first and second arrangement of conductors themselves may comprise two or three parallel running or in a meandering way running rows of conductors displaced against each other in order to render more difficult unauthorized accesses to the key contacts.

Another further embodiment of the present invention may be that each conductor of the second arrangement is formed by two electrical contacts separated by a non-conductive area. The electrical contacts are applied with voltage for electrically bridging the non-conductive area of first arrangement via the conductors of the second arrangement.

In summary, this inventive foil keyboard provides a simple and low cost keyboard combining the security standard for protecting security-relevant data inside the keyboard as well as providing additional security requirements with respect to unauthorized mechanical access to the key contacts without requiring additional components.

Figure 2B:
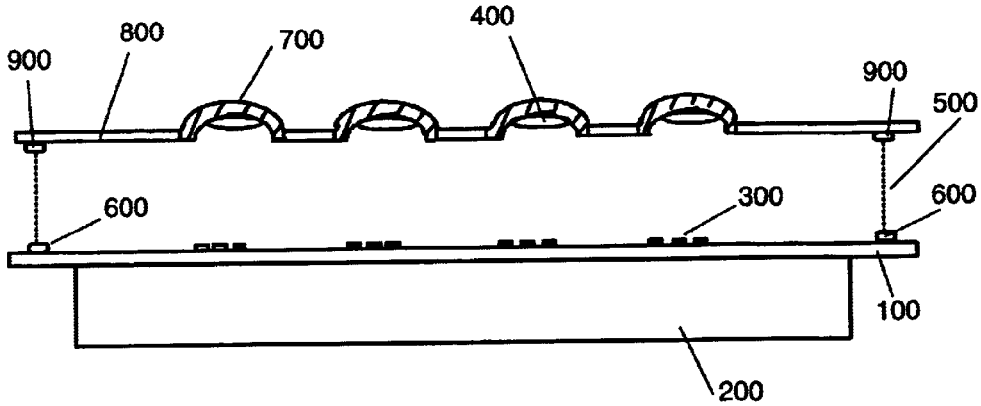
FIG. 2B shows a sectional view through the single components of the inventive foil keyboard in a non-assembled state.

FIG. 2B shows sectional view through the single components of the inventive foil keyboard in a non-assembled state.

The keyboard foil 800 comprises a first arrangement of conductors 900 arranged around the key entry block. The embossed part of the keyboard foil 800 that forms the elastic spring zone for the key 700 contains at its inner part contact material 400. The keyboard foil 800 is preferably a thermoformed polyester foil. The PCB 100 comprises electrical contacts 300 for the keys, a second arrangement of conductors 600 as well as electrical contacts 500 arranged at the conducts for connecting first 900 and second 600 arrangement of conductors. The PCB 100 is attached to the security module 200 that is encapsulated with a security film.

Figure 3A:
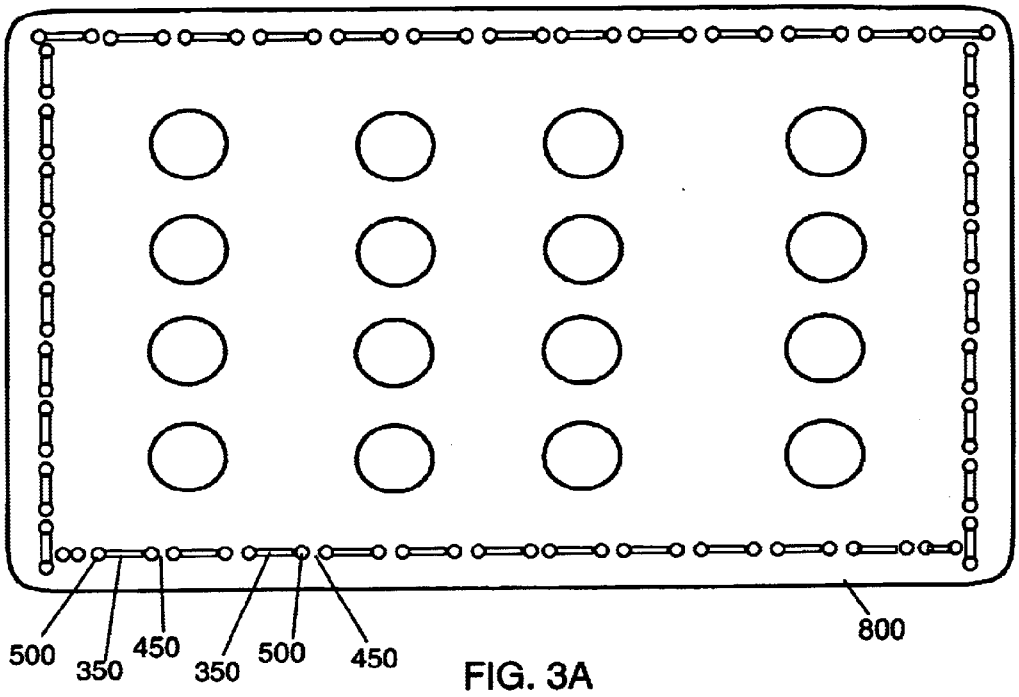
FIG. 3A shows the basic embodiment of the first arrangement of conductors in accordance with the present invention.

FIG. 3A shows the shape of the basic embodiment of the first arrangement of conductors disposed at the inner surface of the keyboard foil 800. The conductors 350 are preferably squarely arranged around the key entry block and separated from each other by non-conductive areas 450. Each conductor 350 of the first arrangement has two electrical contacts. Each electrical contact 500 of the first arrangement connects another conductor of the second arrangement of conductors. This applies accordingly for the electrical contacts of the second arrangement of conductors. Consequently, the second arrangement of conductor placed at the PCB must have the same structure as the first arrangement (not shown) and is preferably identical in shape and size.

Figure 3B:
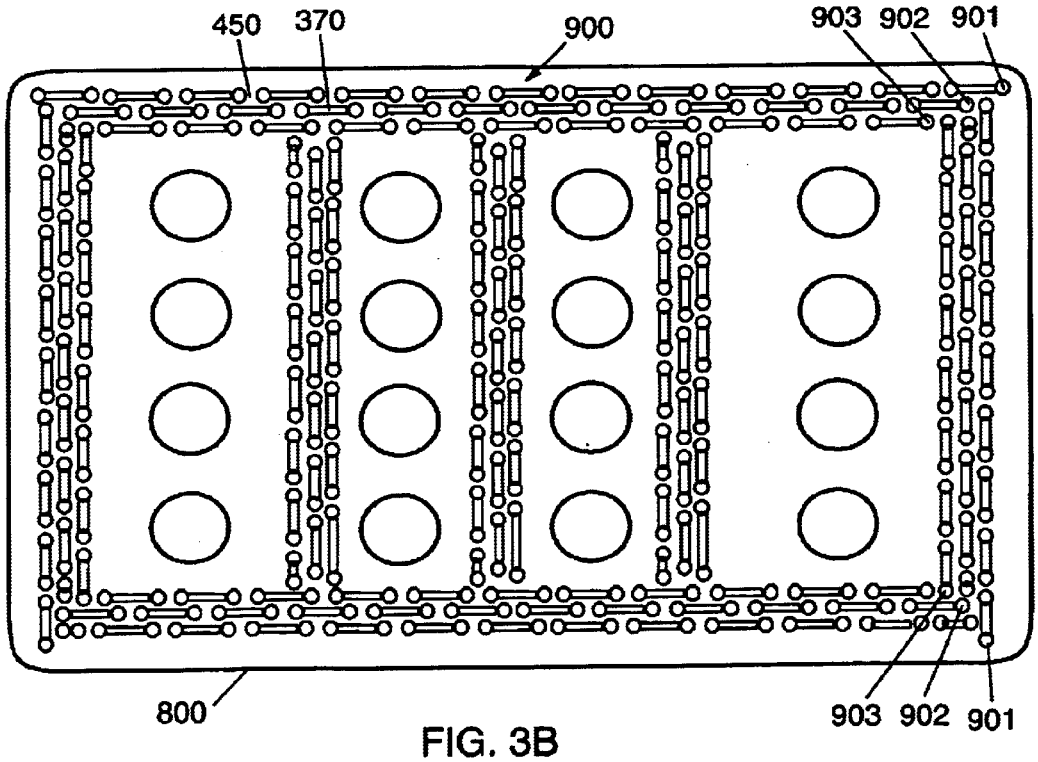
FIG. 3B shows another embodiment of the first arrangement of conductors in accordance with the present invention.

FIG. 3B shows another embodiment of the first arrangement of conductors in accordance with the present invention. The keyboard foil 800 that comprises the first arrangement of conductors 900 is arranged at the inner surface of the keyboard foil 800 and placed around the key entry block area. The first arrangement of conductors 900 comprises three rows of conductors 901–903 parallel running to each other around the key entry block area. The arrangement of the rows 901–903 to each other should be selected such that there is no space for a mechanical access between first 901 and second 902 row or second and third row, e.g. a non-conductive area 450 of the first row 901 has an opposite conductor 370 of the second row 902 and so on. Consequently, the second arrangement of conductor placed at the PCB must have the same structure as the first arrangement (not shown) that means it comprises also three rows of conductors parallel running to each other. Each pair of first and second arrangement of conductors may form a self closed circuit or all rows of the first and the second arrangement of conductors are connected with each other so that a common closed circuitry is built.

Figure 4:
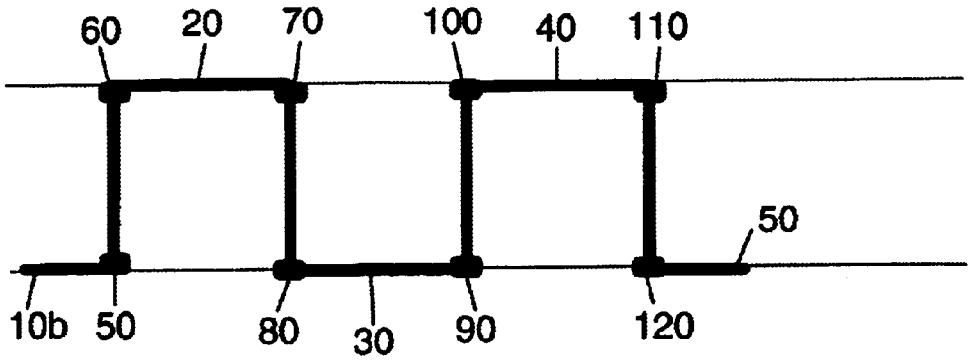
FIG. 4 shows a schematic view of the connection between conductors of the first and second arrangement of conductors.

FIG. 4 shows a schematic view of the connection between conductors of the first and second arrangement of conductors. The following connection scheme between a first and second arrangement is preferably used: electrical contact 50 connects Conductor 10*b* of the second arrangement (not shown) with electrical contact 60 of conductor 20 of the first arrangement, that conductor 20 has a further electrical contact 70 which connects conductor 20 of the first arrangement with electrical contact 80 of conductor 30 of the first arrangement, that conductor 30 has a further electrical contact 90 which connects conductor 30 of the first arrangement with electrical contact 100 of conductor 40 of the second arrangement, conductor 40 has a further electrical contact 110 which connects conductor 40 of the second arrangement with electrical contact 120 of conductor 50 of the first arrangement and so on until a closed circuit between first and second arrangement is built.

Figure 5:
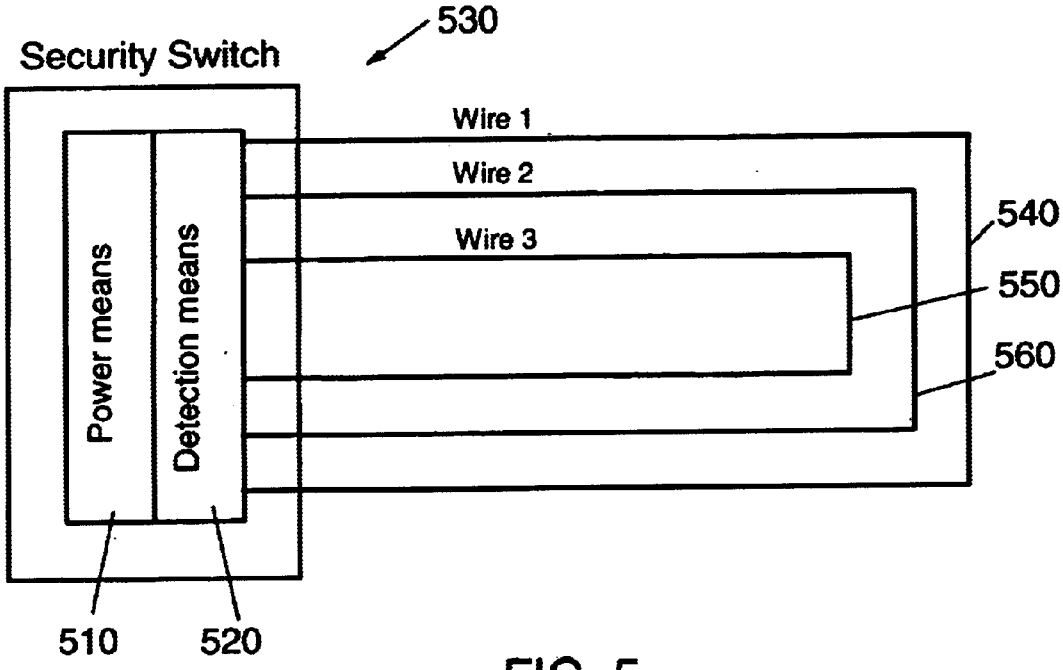
FIG. 5 shows a schematic diagram of the security switch used by the present invention.

FIG. 5 shows a schematic diagram of the security switch used by the present invention.

The security switch 530 preferably comprises a power means 510, detection means 520, and wires 540, 550, 560 for providing a closed circuit between first and second arrangement of conductors. Any mechanical access will be detected by the detection means of the security switch and will then erase all security-relevant data. The security switch is preferably arranged inside the security module.

In the drawings and specifications there has been set forth a preferred embodiment of the invention and, although specific terms are used, the description thus given uses terminology in a generic and descriptive sense only and not for purposes of limitation.

We claim as our invention:

1. A keyboard comprising:

a keyboard foil having a key entry block, a plurality of keys, and a first arrangement of conductors arranged at the inner surface of said keyboard foil surrounding the key entry block wherein the conductors are separated from each other by non-conductive areas;

a printed circuit board having counter-contacts for the keys and having a second arrangement of conductors arranged such that the conductors are separated from each other by non-conductive areas;

a plurality of electrical contacts which electrically connect the conductors of the first arrangement of conductors with the conductors of the second arrangement of conductors for electrically bridging the non-conductive areas of the first and second arrangement of conductors in order to build a closed circuit; and a security circuit which comprises a power module which provides electrical power to the closed circuit, and a detector which detects a change of electrical power in the closed circuit.

2. The keyboard of claim 1, wherein the first and second arrangement of conductors are identical in shape and size at the contact area.

3. The keyboard of claim 2, wherein the conductors of the first and second arrangements of conductors are disposed such that each non-conductive area of the first arrangement is electrically bridged via an electrical contact with an opposite conductor of the second arrangement of conductors and each non-conductive area of the second arrangement of conductors is electrically bridged by via the electrical contact with an opposite conductor of the first arrangement of conductors in order to build the closed circuit between the first and second arrangement of conductors when power is applied.

4. The keyboard of claim 1, wherein the electrical contacts are arranged at each conductor of the first and second arrangement of conductors.

5. The keyboard of claim 1, wherein the first and the second arrangement of conductors comprise at least two rows of parallel conductors running around the key entry block wherein the assigned rows of the first and the second arrangement of conductors are disposed such that each non-conductive area of a row of the first arrangement is electrically bridged via an electrical contact with an opposite conductor of a row of the second arrangement of conductors and each non-conductive area of the row of the second arrangement of conductors is electrically bridged by via the electrical contact with an opposite conductor of the row of the first arrangement of conductors in order to build the closed circuit between the row of the first and second arrangement of conductors when power is applied.

6. The keyboard of claim 5, wherein all rows of the first and the second arrangement of conductors build a common closed circuit.

7. The keyboard of claim 5, wherein each assigned pair of the first and second arrangement of conductors build a self closed circuit.

8. The keyboard of claim 1, wherein the first and the second arrangement of conductors comprise at least two rows of conductors running in a meandering way around the key entry block wherein the assigned rows of the first and the second arrangement of conductors are disposed such that each non-conductive area of a row of the first arrangement is electrically bridged via an electrical contact with an opposite conductor of a row of the second arrangement of conductors and each non-conductive area of the row of the second arrangement of conductors is electrically bridged by via the electrical contact with an opposite conductor of the row of the first arrangement of conductors in order to build the closed circuit between the row of the first and second arrangement of conductors when power is applied.

9. The keyboard of claim 8, wherein all rows of the first and the second arrangement of conductors build a common closed circuit.

10. The keyboard of claim 8, wherein each assigned pair of the first and second arrangement of conductors build a self closed circuit.

11. The keyboard of claim 1, wherein said keyboard foil is a thermoformed polyester foil having an integrated elastic spring zone for each key.

12. The keyboard of claim 11, wherein the inner surface of the elastic spring zone contains an electrical contact for contacting the counter-contact assigned to each key of said printed circuit board during key travel.

13. The keyboard of claim 1, wherein said security circuit is housed in a security module.

14. The keyboard of claim 1, wherein the conductors of the first and second arrangement of conductors are electrical conductive wires.

15. A keyboard comprising:

a keyboard foil having a key entry block, a plurality of keys, and a first arrangement of conductors arranged at the inner surface of said keyboard foil surrounding at least the entire key entry block wherein the conductors are separated from each other by non-conductive areas;

a printed circuit board having counter-contacts for the keys and having a second arrangement of conductors arranged such that the conductors are separated from each other by non-conductive areas;

a plurality of electrical contacts which electrically connect the conductors of the first arrangement of conductors with the conductors of the second arrangement of conductors for electrically bridging the non-conductive areas of the first and second arrangement of conductors in order to build a closed circuit; and a security circuit which comprises a power module which provides electrical power to the closed circuit, and a detector which detects a change of electrical power in the closed circuit.

* * * * *